US008656683B2

(12) United States Patent
Hedditch et al.

(10) Patent No.: US 8,656,683 B2
(45) Date of Patent: Feb. 25, 2014

(54) SHUTTER

(75) Inventors: Bryce Neil Hedditch, Ballan (AU); Anton Paarhammer, Ballan (AU)

(73) Assignee: Sonnenschutz, Pty Ltd (AU)

( * ) Notice: Subject to any disclaimer, the term of this patent is extended or adjusted under 35 U.S.C. 154(b) by 0 days.

(21) Appl. No.: 13/336,728

(22) Filed: Dec. 23, 2011

(65) Prior Publication Data

US 2013/0160383 A1 Jun. 27, 2013

(51) Int. Cl.
*E06B 5/16* (2006.01)

(52) U.S. Cl.
USPC ..... 52/784.11; 52/202; 52/DIG. 12; 52/783.13; 52/784.15

(58) Field of Classification Search
USPC ..... 52/202, 203, DIG. 12, 232, 783.13, 52/784.1, 784.11, 784.12, 784.13, 784.14, 52/784.15
See application file for complete search history.

(56) References Cited

U.S. PATENT DOCUMENTS

| | | | | | |
|---|---|---|---|---|---|
| 4,015,386 | A * | 4/1977 | Cook | 52/232 |
| 4,282,687 | A * | 8/1981 | Teleskivi | 49/503 |
| 4,363,351 | A * | 12/1982 | Eriksen | 160/187 |
| 4,462,194 | A * | 7/1984 | Wahner | 52/309.11 |
| 4,569,872 | A * | 2/1986 | Miller | 428/71 |
| 5,167,098 | A * | 12/1992 | Blackwelder | 52/91.1 |
| 5,215,806 | A * | 6/1993 | Bailey | 428/184 |
| 5,335,452 | A * | 8/1994 | Taylor | 49/463 |
| 5,487,243 | A * | 1/1996 | Hale et al. | 52/202 |
| 5,735,639 | A * | 4/1998 | Payne et al. | 405/129.57 |
| 6,096,416 | A * | 8/2000 | Altenberg | 428/317.7 |
| 6,470,639 | B1 * | 10/2002 | Horn et al. | 52/309.16 |
| 7,603,822 | B2 * | 10/2009 | Kosny et al. | 52/282.1 |
| 7,934,349 | B1 * | 5/2011 | Romig | 52/653.1 |
| 2007/0028535 | A1 * | 2/2007 | Pandorf | 52/202 |
| 2007/0256373 | A1 * | 11/2007 | Collard | 52/202 |

FOREIGN PATENT DOCUMENTS

| | | | | |
|---|---|---|---|---|
| EP | 90625 | A2 * | 10/1983 | E04C 2/26 |
| EP | 0294265 | A1 * | 5/1988 | |
| JP | 2009007874 | A * | 1/2009 | |

* cited by examiner

*Primary Examiner* — Adriana Figueroa
(74) *Attorney, Agent, or Firm* — Levenfeld Pearlstein, LLC

(57) ABSTRACT

A shutter 20 including an outer sheet 50 and a non-combustible insulating panel 51. The panel 51 is positioned between the outer sheet 50 and a frame 52. The outer sheet 50 overlies a broad face of the panel 51 and the frame 52 is attached adjacent to a second broad face of the panel 51 opposite the first broad face. The outer sheet 50 has a melting point of greater than or equal to about 840° C. The panel 51 is operable to retard heat transmission from the first face to the second face so that when the first face is exposed to a temperature of 730° C. for a period of 15 minutes, the temperature of the second face does not exceed 250° C. Each of the outer sheet 50 and the panel 51 are secured to the frame 52 and the frame is substantially resistant to distortion of up to a temperature of about 250° C.

20 Claims, 4 Drawing Sheets

SHUTTER

FIELD OF THE INVENTION

The present invention relates to a shutter for closing over a window, door or other opening of a building, for protecting the window, door or opening during extreme temperature conditions, as can occur during fires, in particular bushfires. The invention has been developed particularly in relation to the protection of windows and it will therefore be convenient to describe the invention in that context. However, it will be appreciated that the invention has wider application to doors or other openings, such as chimneys, flues or air vents.

BACKGROUND OF THE INVENTION

Windows, doors or other openings in buildings form parts of the building structure which can fail during extreme temperature conditions and which thereafter allow entry into the building of flames and embers, and of oxygen which fuel the flames and embers. Once a fire is established within a building, it is difficult to save the building from complete destruction. Accordingly, it is recognised that protection of windows, doors and other openings in a building is important in order to protect buildings against destruction by fire.

Windows can be protected by shutters which typically are positioned to form a cover over the external side of the window. Shutters exist already to close over a window and certain shutters have been developed for protection of windows in bushfire conditions. However, shutters of which the applicant is aware typically are aluminium roller shutters and a disadvantage with these shutters is that the melting temperature of aluminium can be lower than the temperature to which the shutter is exposed during a bushfire, so that the aluminium shutter could melt in such extreme temperature conditions. For that reason, recent amendments in Australia to building standards require shutters used for protection in bushfire conditions to continue to operate in a protective manner in temperatures exceeding the melting point of aluminium, i.e. in temperatures beyond 700° C.

Some existing shutters have been constructed in steel, which has a higher melting temperature than aluminium and so does not suffer the same drawbacks as aluminium. However, these shutters do not prevent transmission of radiant heat from the external or fire side of the shutter to the internal or non-fireside, and because of that radiant heat transmission, it is often the case that the window frame or the glass of the window fails even though the shutter is in a position covering the window. These forms of shutters also have sealing issues and therefore can leave gaps between the shutter and the surrounds of the window and this allows ingress of embers and oxygen.

There are also flame and smoke control 'curtain' type products, typically used in indoor environments to prevent the spread of fire from one area of a building to another. These products however have limited benefit when applied externally over windows or doors, as they can be deflected or shifted by wind, or if hit by flying embers and other debris for example, causing the glass of the window to break or allowing ember and heat access to the frame of the window or door. Such curtain type products are also not primarily designed for deflecting the heat, so that they can allow the cavity between the curtain and the window or door to get excessively hot and thus cause the window glass or window or door frame to fail.

Some curtain fabrics exist that do have fire retardant or heat reflective properties, but these fabrics are not necessarily capable of long term external use. In addition, they can also present difficulties for mounting, so that prohibitively expensive and difficult mounting arrangements are required.

Accordingly, applicant is not aware of a shutter which operates successfully under extreme temperature conditions as can occur during some extreme bushfire events. The applicant has therefore developed a new and unique shutter which aims to overcome or at least alleviate some of the disadvantages with shutters of the prior art.

SUMMARY OF THE INVENTION

According to the present invention there is provided a shutter comprising:

an outer sheet of generally square or rectangular shape, a non-combustible insulating panel of generally the same shape as the outer sheet, and a frame, the panel being positioned between the outer sheet and the frame so that the outer sheet overlies a first broad face of the panel and the frame is attached adjacent to a second broad face of the panel which is opposite the first face, the outer sheet having a melting point of greater than or equal to about 840° C., the panel being operable to retard heat transmission from the first face thereof adjacent to the outer sheet to the second face opposite the first face, so that when the first face is exposed to a temperature of 730° C. for a period of 15 minutes, the temperature at the second face does not exceed 250° C., each of the outer sheet and the panel being secured to the frame and the frame being substantially resistant to distortion up to a temperature of about 250° C.

A shutter of the above kind advantageously can protect a window, door or other opening from both direct flame and from radiant heat, thereby increasing the likelihood of the window, door or other opening surviving extreme temperature conditions. Moreover, the shutter can limit the progression of heat through the window, door or other opening, so that occupants of a building which is subject to an extreme temperature condition, for example a bushfire, can be subject to reduced temperature within the building than would otherwise be the case if the shutter was not fitted to the window, door or other opening. Still further, a shutter according to the invention can be made to have a aesthetically pleasing appearance despite its required construction, which is important given that the shutter is an external fitting which is on view at all times.

The outer sheet of a shutter according to the invention can be of any suitable material, although a metal outer sheet is considered at this stage to be most appropriate, in particular a steel sheet. Testing to date has employed successfully a 0.5 mm "Colourbond" steel sheet.

Other materials suitable for adoption for the outer sheet could be employed subject to satisfying the requirement of providing a resistance to melting up to 840° C. Such materials could include metals or fabrics having suitable fire resistance. In the testing to date, a 0.5 mm "Colourbond" steel sheet has provided a non-combustible layer which has resisted melting at temperatures of up to 840° C. Advantageously, such a steel sheet has also provided a suitable barrier against penetration of flame and oxygen to the internal side of the shutter. In addition, that material also is cost effective compared to other materials that could be employed.

The non-combustible insulating panel can also be manufactured from any suitable material, but in testing to date, a suitable panel has been found to comprise a 13 mm thick plasterboard which is supplied by Lafarge Plasterboard Ltd under the product name "Firestop". However, it is envisaged that various other materials could satisfy the requirements of the insulating panel of the invention, for example fibrous materials or foam materials, and it is expected that panel thicknesses of between 10 to 16 mm could be employed. Panels of greater or lesser thickness could be employed, but greater thickness panels could increase the bulk of the shutter beyond acceptable levels, while panels of reduced thickness could require more expensive materials that increase the cost of the shutter prohibitively.

The outer sheet overlies the insulating panel and each of the outer sheet and the insulating panel are attached to or supported by the frame. In some forms of the invention, the outer sheet and the insulating panel can be fixed together and in one arrangement, an adhesive is employed for that purpose. In some forms of the invention, the adhesive can be selected to fail at a certain upper temperature, with the outer sheet then being supported by the frame when adhesive failure takes place. The benefit of selecting an adhesive which will fail at a particular temperature is to allow expansion of the outer sheet during an extreme temperature event. By this mechanism, the adhesive fails which then allows the outer sheet to expand under the extreme temperature, but the outer sheet is maintained in position, albeit less precisely, by the frame. Thus, while allowance is made for some shifting or movement of the outer sheet, that movement is not sufficient to expose the insulating panel to direct flame, and the outer sheet thus continues to perform the function of providing a barrier against flame and oxygen penetration through the shutter. Accordingly, while the aesthetic appearance of the shutter might deteriorate upon failure of the adhesive, the structural integrity of the shutter remains intact and the shutter continues to form an effective barrier and temperature retarder, protecting the window, door or opening over which the shutter has been placed.

Many suitable adhesives are likely to be available which meet the requirements for fixing the outer sheet and panel in the shutter and for failing at a selected temperature if required. In testing conducted to date, a construction adhesive, Selleys Silicone 401 industrial engineering adhesive sealer, has been successfully employed, having a 205° C. failure temperature.

Screws can be employed for various fastening requirements. For example, screws can be employed for fastening the outer sheet and the panel to the frame, whereby the screws extend through the outer sheet and the panel and into engagement with the frame. However, it is preferred to minimise the number of screws used because during an extreme temperature event such as a bushfire, heat can be conducted through a screw which projects from the external side of the shutter through to the internal side of the shutter. This conduction can raise the temperature to which the window is exposed and thus excessive conduction can detract from the performance of the shutter and potentially lead to window failure. Additionally, where the screws are fixed to the frame, conduction through the screws can result in heating of the frame and excessive heating can distort the frame and again, detract from the performance of the shutter. Accordingly, by minimising the number of screws which are employed, heat transmission of this kind is minimised and the likelihood of window failure or of frame distortion occurring is likewise minimised.

For further fixing of the outer sheet and the panel, the frame can include or define a lip or flange, or a channel, within which edge regions of the outer sheet can be captured or located. In this arrangement, edge regions of the outer sheet can be adhesively fixed to the lip, flange or channel, or fixed by suitable fasteners, such as rivets, or they can simply be positioned within the lip, flange or channel. The panel can also be adhesively fixed to the frame, or it can be fixed to the frame by suitable fasteners, or both. The panel can also be positioned within the lip, flange or channel in the same manner as the outer sheet. The lip, flange or channel can extend completely or partially about the periphery of the outer sheet and the panel.

The frame can be of any suitable shape, construction and material. Testing to date has been conducted with a steel frame, partly of square hollow section (SHS), with dimensions 20×20×2.5 mm. However, it is clearly possible that alternative sections could be used, such as rectangular hollow section (RHS), or right-angle section.

The frame can have a generally rectangular or square configuration and be located about the periphery or edge regions of the insulating panel, on the opposite side to the outer sheet. However, the frame could be positioned inboard of the edges, or it could extend diagonally across the second face of the panel from each upper corner of the panel to an opposite lower corner. Other frame configurations are possible.

The frame can thus consist of a portion that is positioned adjacent to the second face of the panel and a lip, flange or channel portion that extends about the edges of the panel and the outer sheet to capture or confine the edges.

As indicated above, the frame is required to be substantially resistant to distortion up to a temperature of about 250° C., which is the maximum temperature expected at the second face of the panel if the extreme temperature conditions do not exceed 730° C. for a period of 15 minutes and the maximum temperature does not exceed 840° C. Thus, upon distortion of the outer sheet under extreme temperature conditions, the frame is not caused to distort other than slight or minor distortion. The selection of steel for the frame is considered appropriate for the temperature limit discussed above, while steel also advantageously is capable of gentle distribution of heat throughout the frame structure as the temperature on the internal side of the shutter increases, rather than abrupt distribution or uneven distribution. By this gentle overall increase of the frame temperature, distortion of the frame is minimised.

A seal can be disposed between the side edge regions of the shutter and facing surfaces of the surrounds or frame of the window, door or opening within which the shutter is mounted. The seal can be provided to minimise air exchange from the external side of the shutter to the internal side, and to prevent passage of embers and gases from the external side.

An effective form of seal is an intumescent seal, which increases in volume as the ambient temperature increases. Accordingly, during a fire event, the seal will expand and more firmly engage between the shutter and the frame of the window, door or opening, forming a barrier against air, embers or gases. The advantage of an intumescent seal is that the seal has minimum volume at ambient temperature so that it can be arranged not to interfere with the operation of the shutter in normal temperature conditions. However, the seal expands and forms an interference fit with facing surfaces when the temperature rises to extreme levels. In testing which has been conducted to date, a seal under the name Lorient HP1602AS has been successfully employed.

A seal can also be employed between adjacent shutter leaves and between adjacent sections of a shutter. In fact, a seal can be employed at all joins and openings within the shutter and between the shutter and the surrounds or body within which the shutter is mounted.

A shutter according to the invention can provide an effective barrier against ingress of heat and embers or direct flame to a window, door or other opening to protect the window, door or other opening from failure and thus to protect the building in which the window, door or other opening is installed. A shutter according to the invention can also reduce the temperature increase within the building during an external extreme temperature event, by limiting the transfer of heat from outside the building to inside through the window, door or other opening. Thus, any occupants of the building are likely to be exposed to reduced temperature and are more likely to survive the extreme temperature event. It is to be noted that in bushfires, the fire tends to move through an area relatively quickly and so the period in which building and the building occupants must survive is often a period of minutes rather than hours, but the intensity of the fire is often extremely high for that short period. In testing of a shutter according to the invention undertaken to date, the shutter has survived under simulated extreme bushfire conditions for a typical period under which a building would be subject to the bushfire.

For a better understanding of the invention and to show how it may be performed, embodiments thereof will now be described, by way of non-limiting example only, with reference to the accompanying drawings.

DETAILED DESCRIPTION OF THE INVENTION

Figure 1A:
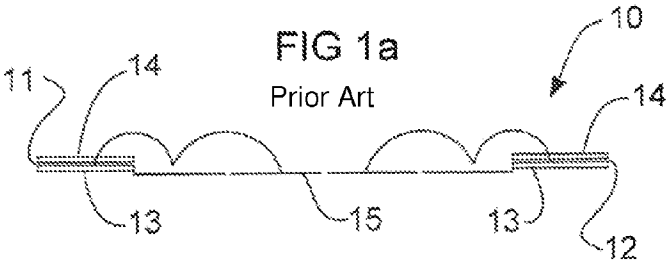
FIG 1a Prior Art
Figure 1B:
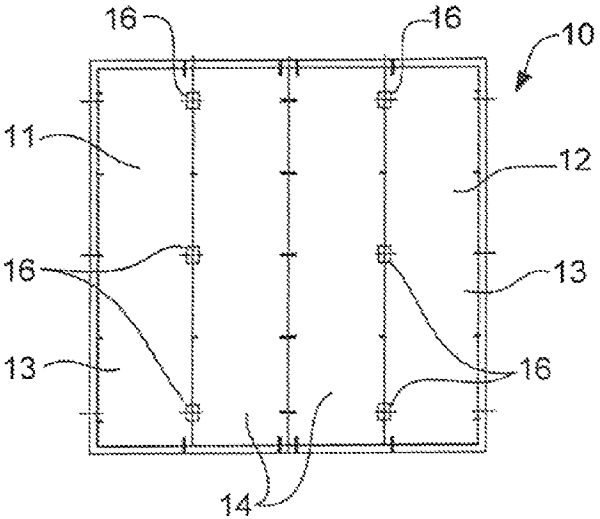
FIG 1b Prior Art

FIGS. 1*a* and 1*b* illustrate a 4 panel bi folding "casement" shutter 10 in a respective fully open position (FIG. 1*a*) and a fully closed position (FIG. 1*b*). FIG. 1*a* illustrates a pair of bi-fold shutters sections 11 and 12, each formed by a pair of shutter leaves 13 and 14 which are fitted to cover an opening represented by broken line 15. The opening can be closed by a window or door (not illustrated).

The shutter leaves 13 and 14 are of equal dimension and each of the shutter leaves 13 is connected to the associated shutter leaf 14 by hinges 16. Likewise, each of the shutter sections 11 and 12 is connected by hinges to the frame or surrounds of the window by hinged connection of the leaves 13 with the frame or surrounds.

In FIG. 1*a*, the shutter leaves 13 and 14 are folded open completely, so that shutter leaf 14 overlies shutter leaf 13, and each shutter section 11 and 12 is fully hinged so that the opening 15 is fully exposed.

Suitable latching arrangements can be employed to retain the shutter sections 11 and 12 in the fully open position of FIG. 1*a*, while the same latching arrangements or different latching arrangements can be employed to retain the shutter sections 11 and 12 closed in the FIG. 1*b* illustration.

The casement shutter 10 is a form of shutter which exists already and which is easily moved between open and closed positions. Such shutters are therefore popular as covers for windows. However, the casement shutter 10 has not heretofore been used as a fire barrier.

Figure 3A:
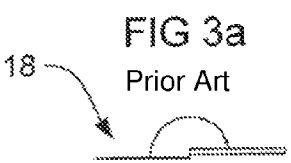
FIG 3a Prior Art
FIGS. 1 to 3 illustrate three different prior art shutter arrangements.
Figure 3B:
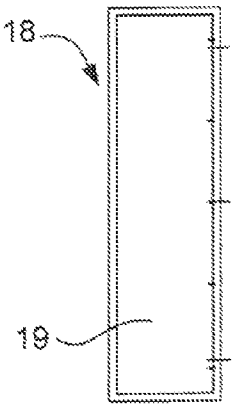
FIG 3b Prior Art
Figure 2A:
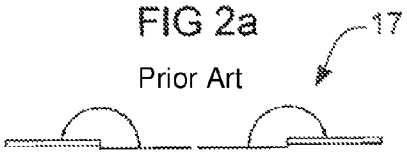
FIG 2a Prior Art
Figure 2B:
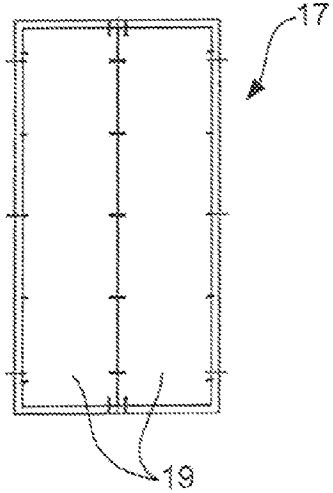
FIG 2b Prior Art

FIGS. 2*a* and 2*b* illustrate a double panel casement shutter 17, while FIGS. 3*a* and 3*b* illustrate a single panel casement shutter 18, each in closed and open conditions respectively. In each case, the shutter leaves 19 are hinged to the window frame for movement between open and closed positions.

Applicant has developed a shutter arrangement which can form a barrier across a window, door or other opening or the like to protect the window, door or opening against exposure to extreme high temperatures, such as those experienced during an intense bushfire. As explained earlier, openings such as windows and doors are prone to fail during an extreme temperature conditions and allow ingress of flame and embers, and oxygen. Accordingly, protecting windows and doors against failure is important in protecting a building against destruction by fire.

A shutter according to the invention can be formed as a casement shutter of the styles depicted in FIGS. 1 to 3. Alternatively, a shutter according to the invention can be similar to that depicted in FIGS. 1*a* and 1*b*, but with a tri-fold arrangement, or greater. Moreover, while the leaves of the shutters illustrated in FIGS. 1 to 3 are hinged along a vertical line, the leaves could be hinged along a horizontal line so that the leaves fold vertically.

Figure 4:
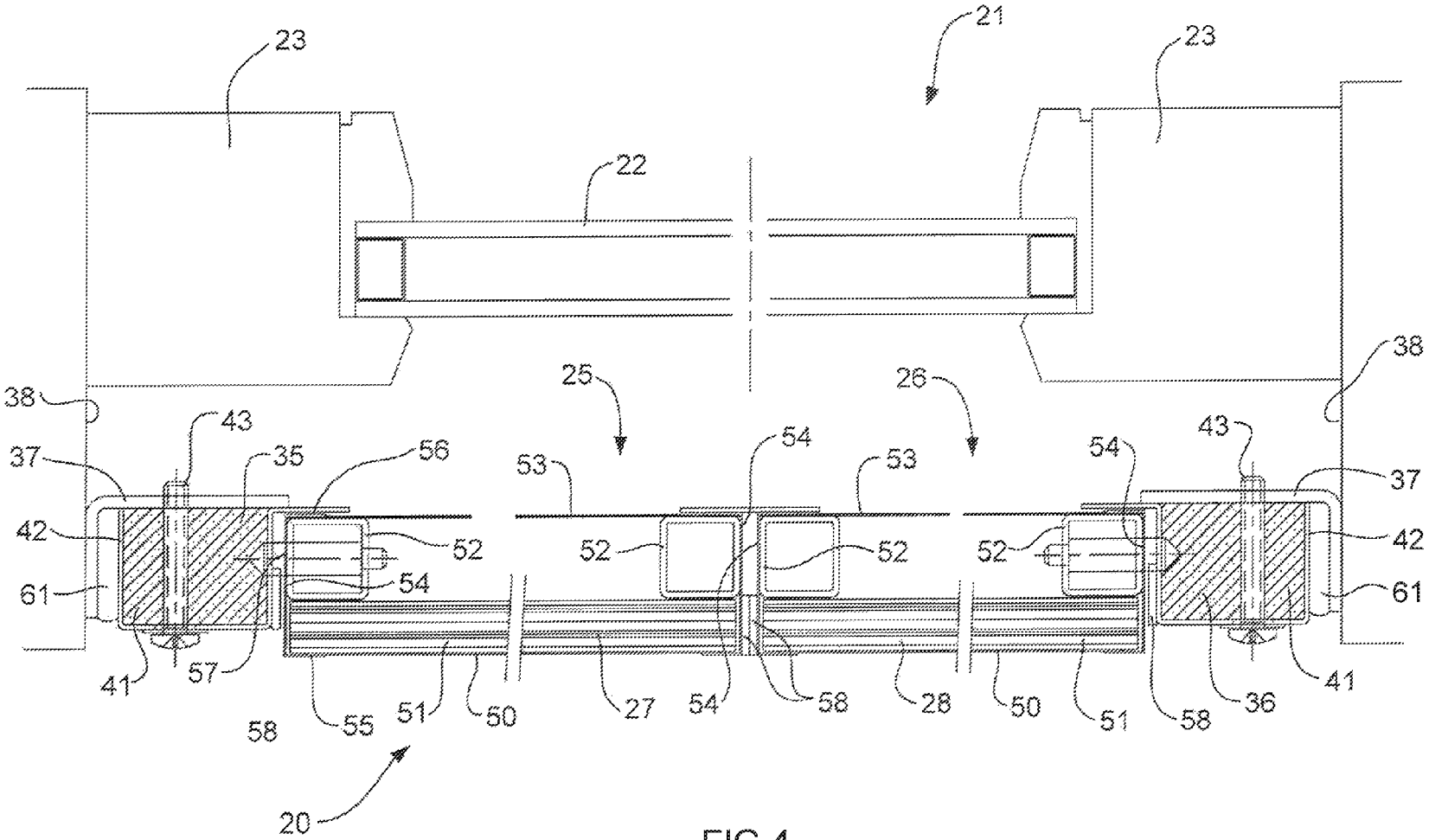
FIG. 4 is a horizontal section of a shutter according to one embodiment of the invention.
Figure 5:
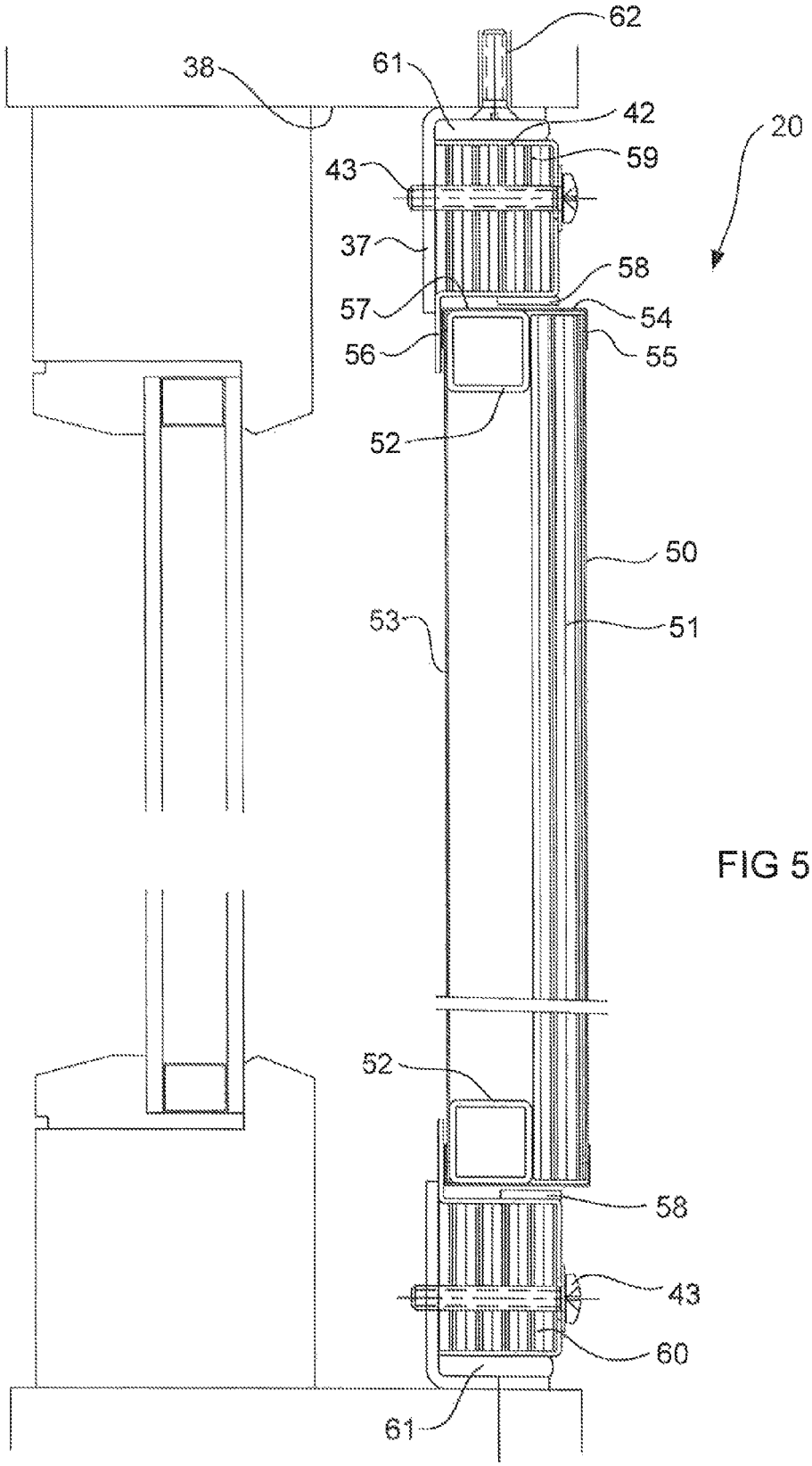
FIG. 5 is a vertical section of the shutter of FIG. 4.

FIGS. 4 and 5 illustrate cross-sectional views of a shutter according to the invention through horizontal and vertical sections respectively. Referring first to the horizontal cross-section of FIG. 4, this depicts a shutter 20 which is fixed over or in front of a window assembly 21. The window assembly consists of a double glazed window pane 22 which is mounted within side styles 23. No further discussion will be made in relation to the window assembly 21 given that the window assembly 21 is not important in relation to describing the invention, although it will be appreciated that the shutter 20 of the invention is provided for the purpose of protecting the pane 22 against failure, and for resisting ingress of flame and embers to the window assembly 21.

The shutter 20 includes a pair of shutter sections 25 and 26 each of which could be formed in a single or bi-fold manner, as illustrated in FIGS. 1 and 2. The shutter sections 25 and 26 thus include separate shutter leaves 27 and 28. The shutter leaves 27 and 28 would be connected by one or more hinges (not shown) to further shutter leaves if the shutter sections 25 and 26 were bi-fold sections.

The shutter sections 25 and 26 are connected to opposite vertical frame assemblies 35 and 36. Each of the frame assemblies includes an angle section 37 which is fixed to the window surround 38 in any suitable manner. The frame assemblies 35 and 36 include hinges (not shown) to which the shutter sections 25 and 26 are connected. The frame assemblies 35 and 36 include a metal frame 42 which cooperates with the angle section 37. The frame assemblies 35 and 36 can include an infill 41 within the metal frame 42 to support a screw 43 which extends through the frame 42 and the infill 41 and into the angle section 37 to secure the frame 42 to the angle section 37. The infill can be of any suitable material. An alternative arrangement employs a metal box section, ie 30×30×2.5 mm SHS, to replace the frame 42 and the infill 41.

The shutter leaves 27 and 28 each comprise an outer metal sheet 50 and a non-combustible insulating panel 51. The outer sheet 50 is disposed on the fire-side or external side of the shutter 20, and it can be seen from both FIGS. 4 and 5, that the outer sheet 50 provides complete coverage for the facing surface of the panel 51.

On the opposite or internal side of the panel 51, a frame 52 is located and this comprises a square frame formed of 20×20×2.5 mm SHS section. The frame 52 is formed as a rectangle, about the periphery of the panel 51.

A rear metal panel 53 extends across the internal side of the shutter 20 and is formed of 0.5 mm steel sheet. The metal panel 53 is attached to the rear side of the frame 52.

The frame 52 includes a flange or channel 54 which defines a front lip 55, a rear lip 56 and a base 57. The flange or channel 54 accepts the periphery of the outer sheet 50, the insulating panel 51, and the rear panel 53. The flange or channel 54 extends fully about the periphery of the respective outer sheet 50, the insulating panel 51 and the rear panel 53.

A seal 58 is disposed between the flange or channel 54 and the metal frame 42 of the frame assemblies 35 and 36 of FIG. 4 and the further frame assemblies 59 and 60 of FIG. 5. The frame assemblies 35 and 36 extend along the side edges of the shutter sections 25 and 26, while the frame assemblies 59 and 60 extend across the top and bottom edges of the shutter sections 25 and 26. The frame assemblies 59 and 60 are formed in the same manner as the frame assemblies 35 and 36 and therefore the same reference numerals are employed for the same parts.

The seals 58 are intumescent seals as described earlier. A further intumescent seal 61 is positioned between the angle section 37 and the frame 42. The seals 58 are prepared seals whereas the seals 61 are a liquid sealant which is applied as one of the last installation steps during installation of shutters according to the invention.

The shutter 20 is easily fitted to the reveal of an existing window, door or other opening. FIG. 5 illustrates a screw 62 which extends through the window surround 38 and it is the case that this form of fixing can be employed about the complete periphery of the shutter 20. The method of assembly, is that the angle sections 37 are first secured to the window surround 38, where after the remaining shutter components are fixed to the angle section 37 via the screw 43. Once that fixing has taken place, the intumescent sealant 61 can be applied to finalise the installation process. The use of the sealant 61 provides some flexibility with tolerances in fitting the shutter 22 a window, as the gap into which the sealant 61 is applied might vary between different windows.

Once installed, it will be appreciated that with the various seals 58 and 61, that the shutter 20 in a closed condition forms a complete barrier against ingress of embers and direct flames to the window assembly 21. Referring to FIG. 4, it can be seen that the seals 58 close all of the gaps in the shutter structure, including between shutter sections 25 and 26. While not illustrated in FIG. 4, similar seals 58 can be employed between respective shutter leaves in a bi-fold shutter arrangement.

Moreover, the resistance to conduction of heat from an external side of the shutter to an internal side, protects the window assembly 21 from the extreme heat on the external side of the shutter 20 during an extreme temperature event, such as a bushfire.

To maintain the shutter 20 in a closed condition, suitable latches can be employed and in testing conducted to date, zinc plated steel padbolts have been employed. However, it is clear that various other latching arrangements could be employed, but what is required is that the padbolt, if applied to the external side of the shutter 20, be able to survive temperatures of the kind that the outer sheet 50 is required to survive and for the same timeframes.

Figure 6:
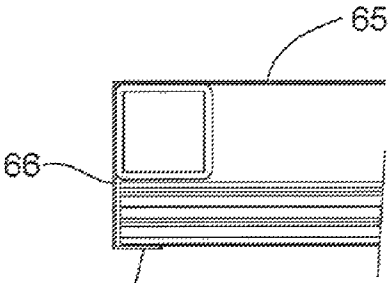

Several variations of the shutter 20 illustrated in FIGS. 4 and 5 have been devised at this stage and include variations illustrated in FIGS. 6 to 9. Referring to FIG. 6, this variation involves the extension of the rear panel 53 of FIGS. 4 and 5 about the side edges of the frame 52, the insulating panel 51 and the outer sheet 50. Thus, instead of the arrangement of the shutter 20, in which a separate channel 54 is provided, in the FIG. 6 arrangement, the rear panel 65 extends to a side portion 66 and to a front lip portion 67. The side and front lip portions 66 and 67 are formed integrally with the rear panel 65.

Figure 7:
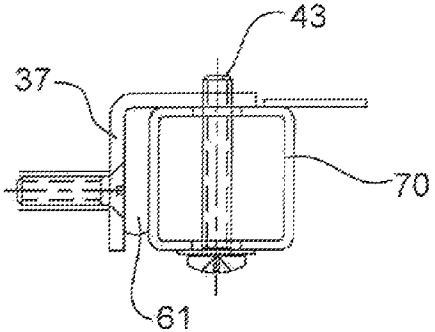

In FIG. 7, a variation is provided in relation to the frame 42 and the infill 41 of the shutter 20. Instead of the frame 42 and the infill 41, a SHS 70 is provided through which the screw 43 extends. It is expected that this variation will be employed in practice, although testing to date has not been conducted in relation to this variation and therefore it remains an option only.

Figure 8:
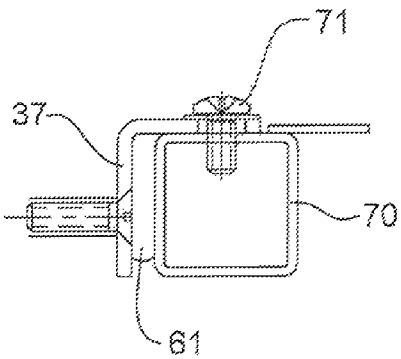

The variation illustrated in FIG. 8 is similar to the variation of FIG. 7, except that a screw 71 extends through the angle section 37 and into only one portion of the SHS 70.

Figure 9:
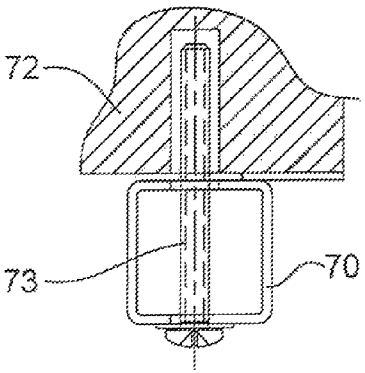
FIGS. 6 to 9 illustrate variations of portions of the shutter illustrated in FIGS. 4 and 5.

The variation of FIG. 9 shows the SHS 70 being fixed directly to the wall face 72 which surrounds a window by a screw 73.

The invention described herein is susceptible to variations, modifications and/or additions other than those specifically described and it is to be understood that the invention includes all such variations, modifications and/or additions which fall within the spirit and scope of the present disclosure.

Throughout the description of this specification the word "comprise" and variations of that word, such as "comprises" and "comprising", are not intended to exclude other additives or components or integers.

The invention claimed is:

1. A shutter including:

an outer sheet of generally square or rectangular shape;

a non-combustible insulating panel of generally the same shape as the outer sheet; and a frame, the panel being positioned between the outer sheet and the frame so that the outer sheet overlies a first broad face of the panel and the frame is attached adjacent to a second broad face of the panel which is opposite the first face, the outer sheet having edge regions and having a melting point of greater than or equal to about 840° C., the panel being operable to retard heat transmission from the first face thereof adjacent to the outer sheet to the second face opposite the first face, so that when the first face is exposed to a temperature of 730° C. for a period of 15 minutes, the temperature at the second face does not exceed 250° C., each of the outer sheet and the panel being secured to the frame, the frame including a lip, flange or channel within which the edge regions of the outer sheet are located and which allows the outer sheet to expand into the lip, flange or channel upon the temperature of the outer sheet increasing while maintaining the outer sheet overlying the first face of the panel, and the frame being substantially resistant to distortion up to a temperature of about 250° C.

2. The shutter according to claim 1, the outer sheet being a metal sheet.

3. The shutter according to claim 2, the outer sheet being a 0.5 mm thick steel sheet.

4. The shutter according to claim 1, the panel being a plasterboard panel.

5. The shutter according to claim 4, the plasterboard panel being between 10 to 16 mm thick.

6. The shutter according to claim 5, the plasterboard panel being 13 mm thick.

7. The shutter according to according to claim 1, the outer sheet and the insulating panel being fixed together by an adhesive.

8. The shutter according to claim 7, the adhesive being selected to fail at a certain upper temperature.

9. The shutter according to claim 8, the adhesive being selected to fail at about 200° C.

10. The shutter according to claim 1, the lip, flange, or channel extending completely about a periphery of the outer sheet and the panel.

11. The shutter according to according to claim 1, a seal being disposed between side edge regions of the shutter and facing surfaces of surrounds or frame portions of the window, door or opening within which the shutter is mounted.

12. The shutter according to claim 11, the seal being an intumescent seal.

13. The shutter according to claim 1, the shutter being a single shutter, a double shutter or a bi-fold shutter.

14. The shutter according to claim 1, the lip, flange or channel being formed as a channel that includes a front lip, a rear lip and a base, wherein the front lip overlies the edge regions of the outer sheet.

15. The shutter according to claim 14, the rear lip of the channel being fixed to a rear surface of the frame and the base of the channel extending about side edges of the frame, the panel and the outer sheet.

16. The shutter according to claim 1, including a rear panel extending across the second face of the panel and the lip, flange or channel being formed as an extension of the rear panel which extends about side edges of the frame, the panel and the outer sheet and which forms a front lip that overlies the edge regions of the outer sheet.

17. The shutter according to claim 16, the rear panel being spaced from the second face of the panel.

18. The shutter according to according to claim 1, edge regions of the outer sheet being adhesively fixed to the portion of the lip, flange or channel that overlies the edge regions of the outer sheet.

19. The shutter according to according to claim 1, the panel being fixed to the frame by adhesive.

20. The shutter according to according to claim 1, edge regions of the panel being positioned within the lip, flange or channel.

* * * * *